US008221149B2

(12) United States Patent
Liu

(10) Patent No.: US 8,221,149 B2
(45) Date of Patent: Jul. 17, 2012

(54) CARD CONNECTOR

(75) Inventor: Chung-Peng Liu, Xizhi (TW)

(73) Assignee: T-Conn Precision Corporation, Taipei (TW)

( * ) Notice: Subject to any disclaimer, the term of this patent is extended or adjusted under 35 U.S.C. 154(b) by 0 days.

(21) Appl. No.: 12/960,517

(22) Filed: Dec. 5, 2010

(65) Prior Publication Data

US 2012/0115369 A1 May 10, 2012

(51) Int. Cl.
*H01R 13/62* (2006.01)

(52) U.S. Cl. ..... 439/328; 439/327

(58) Field of Classification Search ..... 439/329, 439/326, 325, 630, 563, 566, 571, 573
See application file for complete search history.

(56) References Cited

U.S. PATENT DOCUMENTS 5,297,966 A * 3/1994 Brennian et al. ..... 439/64
5,860,828 A * 1/1999 Anderson et al. ..... 439/377
6,019,633 A * 2/2000 Tung et al. ..... 439/570
6,027,357 A * 2/2000 Howell et al. ..... 439/326
6,102,719 A * 8/2000 Tung ..... 439/159
6,386,909 B1 * 5/2002 Hsia et al. ..... 439/541.5
6,731,517 B1 * 5/2004 Yu ..... 361/807
6,796,825 B2 * 9/2004 Wang ..... 439/326
7,287,996 B1 * 10/2007 Shing ..... 439/327
7,661,973 B2 * 2/2010 Lee et al. ..... 439/326
2004/0077218 A1 * 4/2004 Wang ..... 439/638
2005/0136724 A1 * 6/2005 Lin ..... 439/326
2007/0232111 A1 * 10/2007 Shao ..... 439/327
2010/0248517 A1 * 9/2010 Li et al. ..... 439/327
2011/0300734 A1 * 12/2011 Zhu ..... 439/325

* cited by examiner

*Primary Examiner* — Briggitte R Hammond

(57) ABSTRACT

A card connector comprises an insulative housing, two side arms fitting into the two sides of the insulative housing and a positioning set buckled to the side arms. The insulative housing has a slot for adopting the electronic card, and the slot comprises a plurality of conducting terminals. The side arms respectively have a movable arm and a fixed arm. The movable arm and the fixed arm are formed in a single-piece structure. The movable arm is for buckling the electronic card. The positioning set comprises a welding portion, a first plane, a bent portion extending upwardly from the first plane and a second plane extending downwardly from the bent portion. Thus to enable the card connector to automatically adjust the angle between the conducting terminals and the circuit board, thus to maintain the welding end of the conducting terminals and the welding portion of the positioning set on the same plane, in order to steadily weld the conducting terminals to the circuit board and accordingly upgrade the quality of the electrical connection of the card connector.

8 Claims, 7 Drawing Sheets

CARD CONNECTOR

BACKGROUND OF THE INVENTION

1. Field of the Invention

The present invention relates to a card connector, more particularly to a card connector which can be adjustable longitudinally for steadily welding onto a circuit board.

2. Description of Related Art

Connectors are the wildly applied electronic component in the electronic devices, particularly the high precision connector installed on the substrate. The requirement is more strict for the installation on the substrate, such as for the card connector, referring to the conventional card connector FIG. 1, the electrical connector 100' comprises an housing 10', buckling elements 20' positioned at the two ends of the housing 10' and a plurality of conducting terminals 30' positioned within the housing 10'. The buckling element 20' comprises a movable arm 21' and a fixed arm 22'. The fixed arm 22' has a welding portion 221' extending downwards and welded onto the circuit board. The conducting terminals 30' comprise frontal terminals and the rear terminals. When the assembly of the conducting terminals 30' is completed, the pins of the frontal terminals and the rear terminals need to be adjusted onto the same plane.

The structure of the conventional invention includes the fixed arm and the welding portion formed as one piece; since the frontal terminals and the rear terminals of the conducting terminals has a higher density, the welding portion of the fixed arm on the two sides cannot maintain on the same plane with the frontal terminals and the rear terminals of the conducting terminals, thus cause multiple invalid soldering or faulty soldering to the connector and the circuit board, and accordingly to affect the connection reliability of the electrical connector.

To overcome the above defect, the present invention provides a card connector having an assembly of a positioning set and a side arm to enable the card connector to adjust the angle between the conducting terminals and the circuit board, and thereby maintain the frontal and the rear terminals of the conducting terminals and the welding portion of the positioning set on the same plane, and thus can steadily weld the card connector to the circuit board and further securely weld the conducting terminals to the circuit board. The present invention substantially upgrades the quality of the electrical connection of the card connector.

SUMMARY OF THE INVENTION

According to an aspect of the present invention, the card connector includes conducting terminals and the welding portion of the positioning set automatically adjusted to the same plane.

According to another aspect of the present invention, the conducting terminals can be steadily welded onto the circuit board.

For achieving the above objectives, the card connector of the present invention comprises an insulative housing, two side arms fitting into two sides of the insulative housing and a positioning set buckling to the side arms. The insulative housing has a slot for adopting an electronic card, and the slot comprises a plurality of conducting terminals. The side arms respectively have a movable arm and a fixed arm. The movable arm and the fixed arm are formed in a single-piece structure. The movable arm is for buckling the electronic card. The positioning set comprises a welding portion, a first plane, a bent portion extending upwardly from the first plane and a second plane extending downwardly from the bent portion. The positioning set is buckled to the fixed arm.

The insulative housing of the card connector has a positioning groove formed respectively on the two sides, and the side arm has a positioning element of which for inserting into the positioning groove.

The above card connector has the fixed arm on the side arm and the fixed arm has at least one protrusion. The first plane of the positioning set has a buckling hole corresponding to the protrusion.

The above card connector can have the buckling hole on the second plane according to the requirement.

The above card connector has the movable arm on the side arm and the movable arm has a buckling element extending from the distal end of the movable arm and bent downwardly.

The above movable arm of side arm has a stopper at an end without joining with the fixed arm.

The above welding portion of the positioning set has a fixing hole for joining to the circuit board by welding.

The above positioning set of the card connector has a slit between the first plane, the bent portion and the second plane, and the slit is slightly larger than the height and the thickness on the fixed arm thus to enable the fixed arm to move up and down within the slit.

With the above elements, the present invention can buckle the positioning set and the side arm to automatically adjust the angle between the conducting terminals and the circuit board, thus to maintain the welding end of the conducting terminals and the welding portion of the positioning set on the same plane, in order to steadily weld the conducting terminals to the circuit board and accordingly upgrade the quality of the electrical connection of the card connector.

BRIEF DESCRIPTION OF THE DRAWING

For more complete understanding of the present invention, reference will now be made to the following detailed description of preferred embodiments taken in conjunction with the following accompanying drawings.

DETAIL DESCRIPTION OF THE INVENTION

Figure 1:
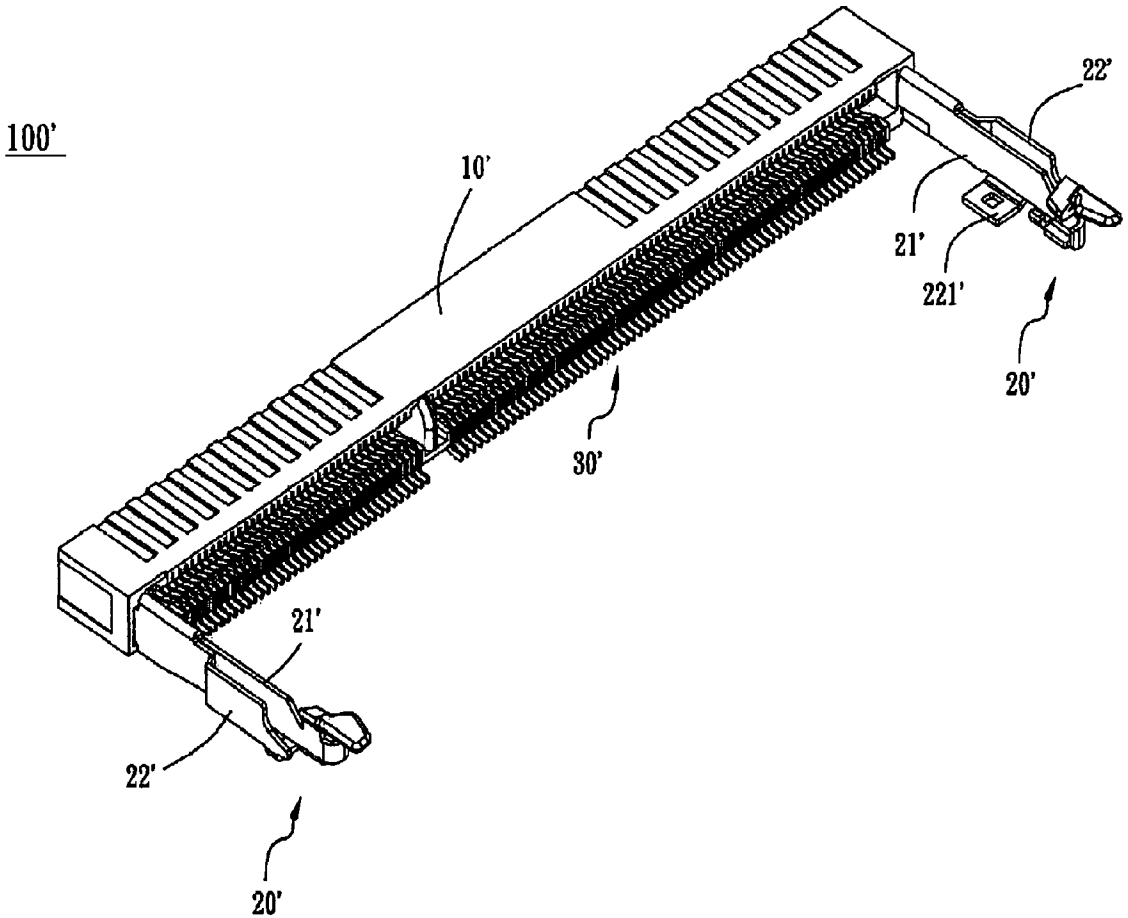
Fig. 1 Prior Art
FIG. 1 is an elevational view of the conventional card connector.
Figure 2:
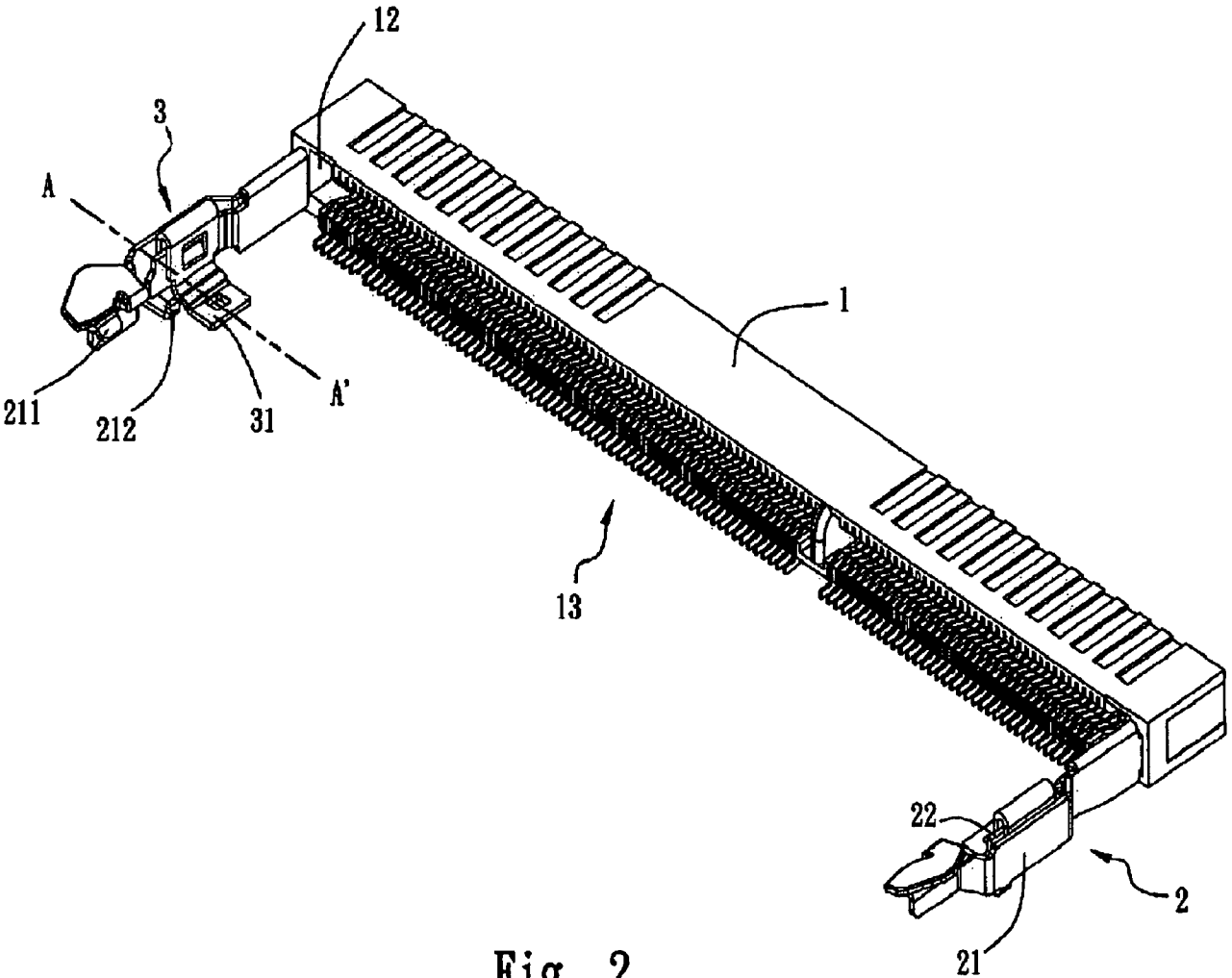
FIG. 2 is an elevational view according to a preferred embodiment of the present invention.

Referring to FIGS. 2 to 5B, the card connector of the preferred embodiment of the present invention comprises an insulative housing 1, two side arms 2 inserted on the two sides of the insulative housing 1 and a positioning set 3 buckling to the two side arms 2. The insulative housing 1 has a slot 12 for adapting the electronic card 4, and the slot 12 comprises a plurality of conducting terminals 13. The insulative housing 1 has the positioning groove 11 respectively formed on the two sides thereof. The side arms 2 respectively comprise a movable arm 21 and a fixed arm 22. The movable arm 21 and the fixed arm 22 are positioned in a single-piece structure. The movable arm 21 is for buckling the electronic card 4 (referring to FIG. 7). The positioning set 3 comprises a welding portion 31, a first plane 32, a bent portion 33 extending upwardly from the first plane 32 and a second plane 34 extending downwardly from the bent portion 33. The positioning set 3 is buckled to the fixed arms 22 respectively.

The movable arm 21 of the side arm 2 has a buckling element 211 extending from the movable arm 21 and bent downwardly. The fixed arm 22 has at least one protrusion 221. The first plane 32 of the positioning set 3 has a hole 321 formed corresponding to the protrusion 221. The hole 321 can be formed on the second plane 34 (not shown in figure). The side arm 2 can have a positioning element 23 for fitting into the positioning groove 11 of the insulative housing 1 (referring to FIG. 3). The welding portion 31 of the positioning set 3 has a positioning hole 311 for joining to the circuit board 5 by welding (referring to FIG. 5B).

Referring to FIGS. 3 to 7, the assembling method of the card connector of the present invention is described as follows.

Figure 3:
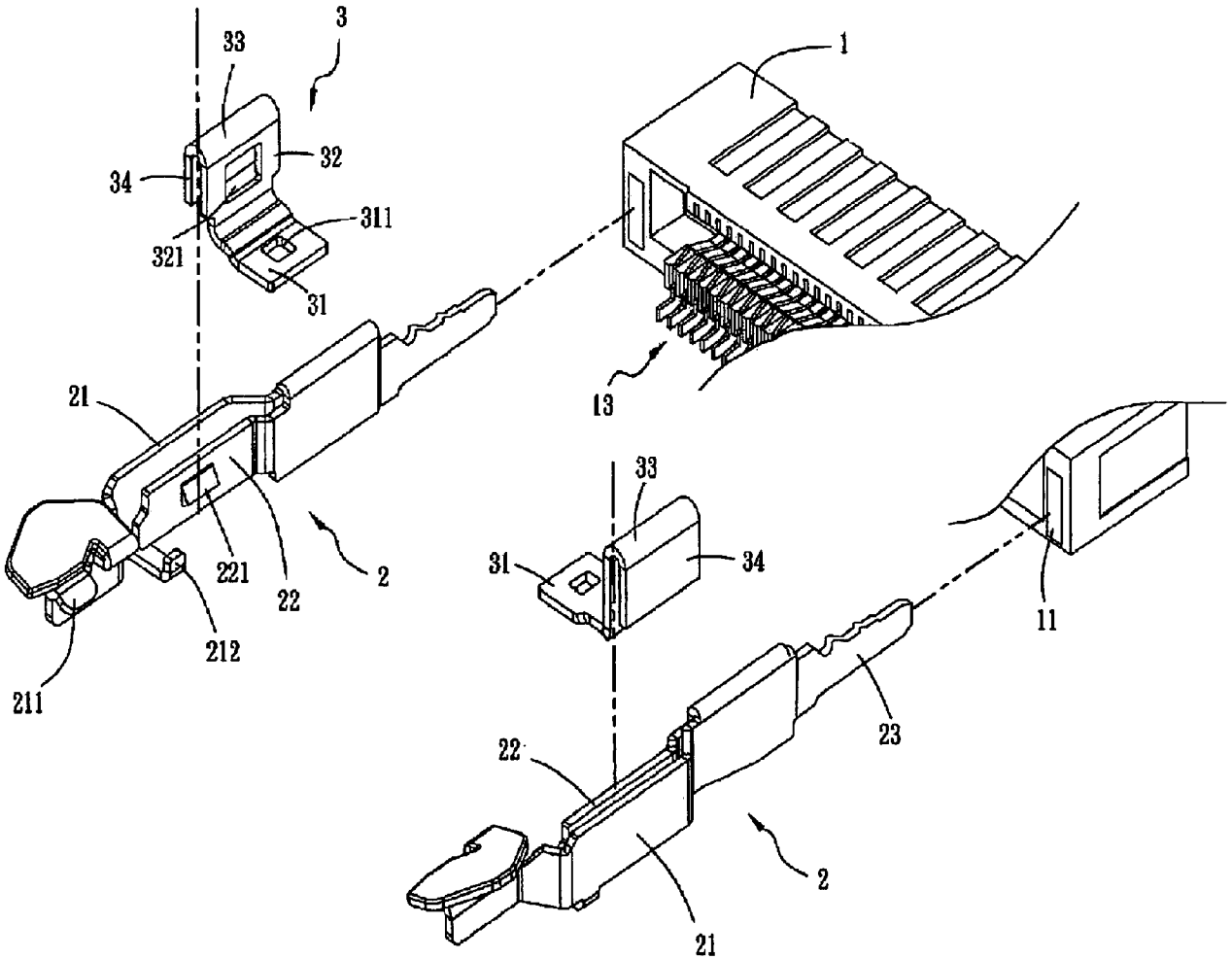
FIG. 3 is an exploded view according to a preferred embodiment of a present invention.
Figure 4:
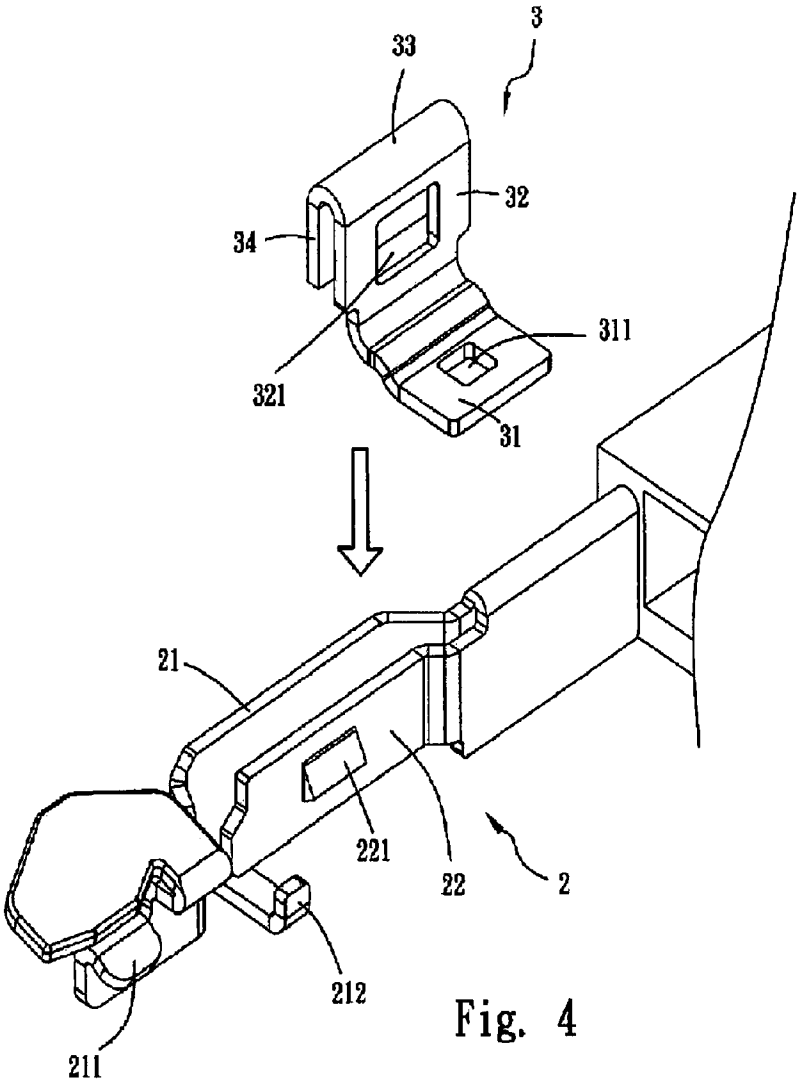
FIG. 4 is an enlarge view illustrating the portion of side arm and the positioning set according to a preferred embodiment of the present invention.

Referring to FIGS. 3 and 4, to assemble the present invention, the positioning element 23 of the side arm 2 is inserted into the positioning groove 11 on the two sides of the insulative housing 1, and the positioning set 3 is placed over the fixing arm 22 of the side arm 2. The movable arm 21 of the present invention has a stopper 212, when the electronic card 4 is adapted with the conducting terminals 13 of the insulative housing 1, the movable arm 21 is pressed by the electronic card 4 and further to eject out, and the sidewall of the fixed arm 22 and the stopper 212 provide a restriction force to right-left movement of the movable arm 21.

Figure 5A:
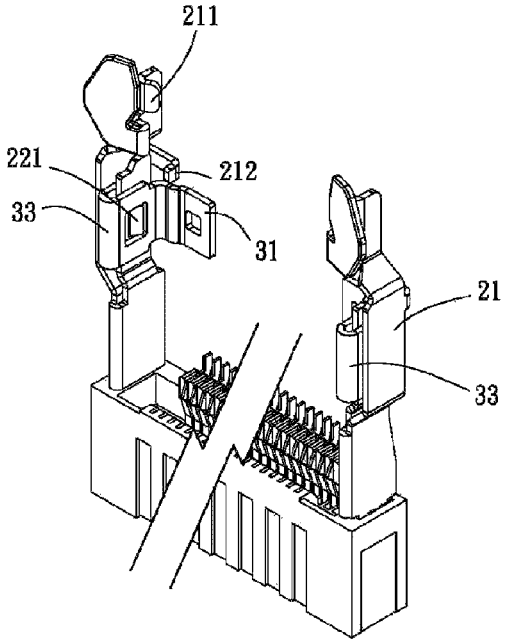
FIG. 5A is an elevational view illustrating in another angle according to a preferred embodiment of the present invention.
Figure 5B:
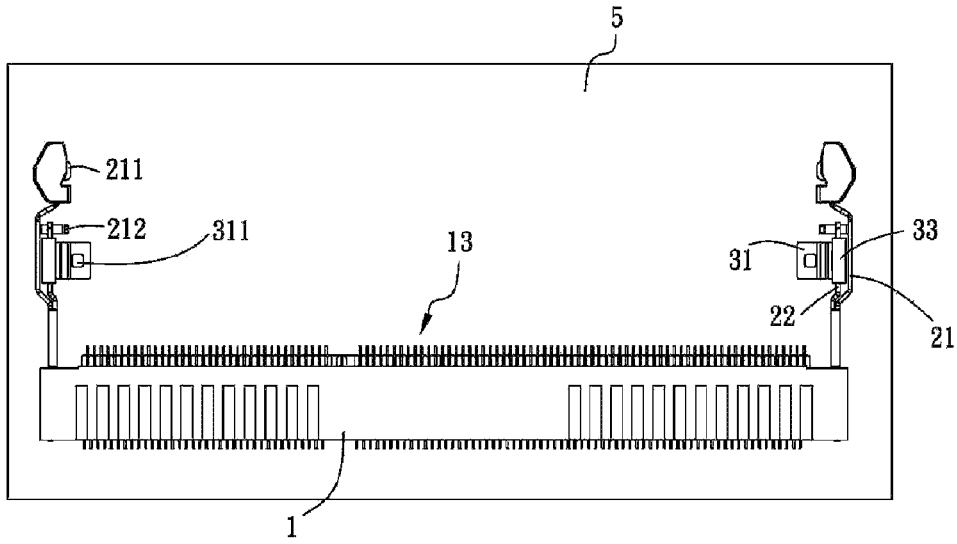
FIG. 5B is a top view according to a preferred embodiment of the present invention.
Figure 6:
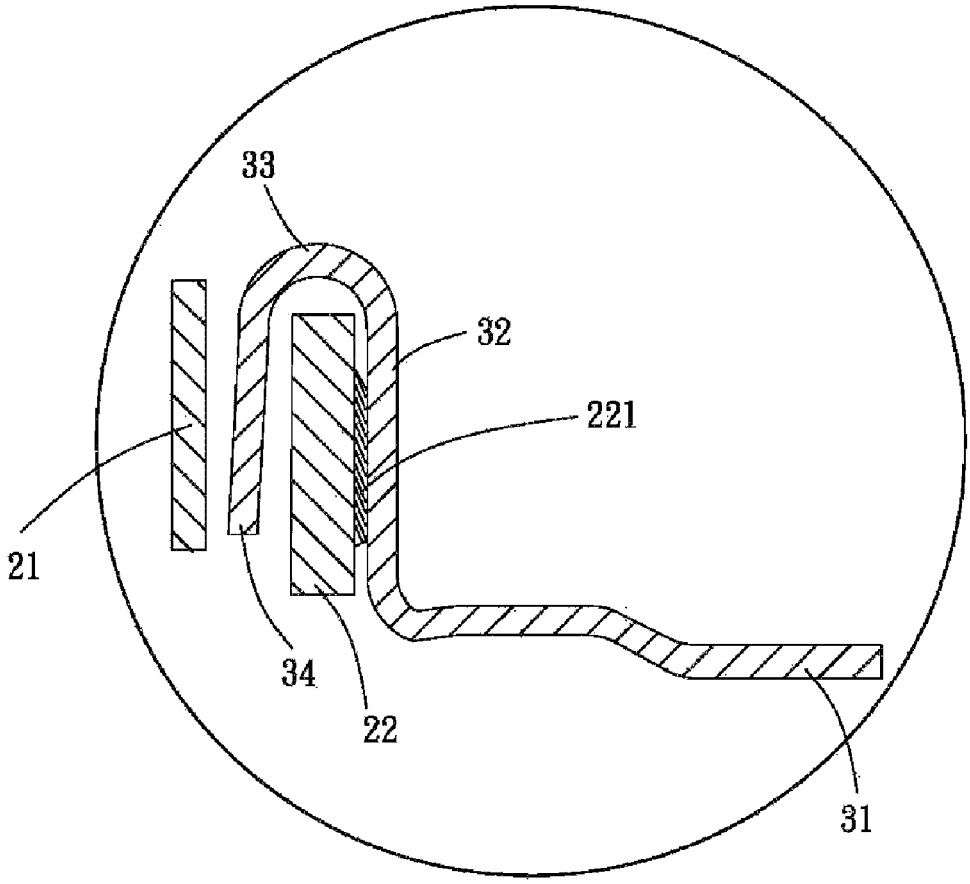
FIG. 6 is a sectional view of A-A' taken from FIG. 2 according to an embodiment of the present invention.

Referring to FIGS. 5A and 6, when the positioning set 3 covers the fixed arm 22, the protrusion 221 of the fixed arm 22 buckles to the hole 321 of the positioning set 3, a slit is formed between the first plane 32, the bent portion 33 and the second plane 34. The slit is slightly larger than the height and the thickness of the fixed arm 22 to allow the fixed arm 22 to move up-down within. To buckle the protrusion 221 of the fixed arm 22 and the hole 321 of the positioning set 3 can restrict the back-fore movement of the fixed arm 22 thus to prevent the positioning set 3 loosen.

Figure 7:
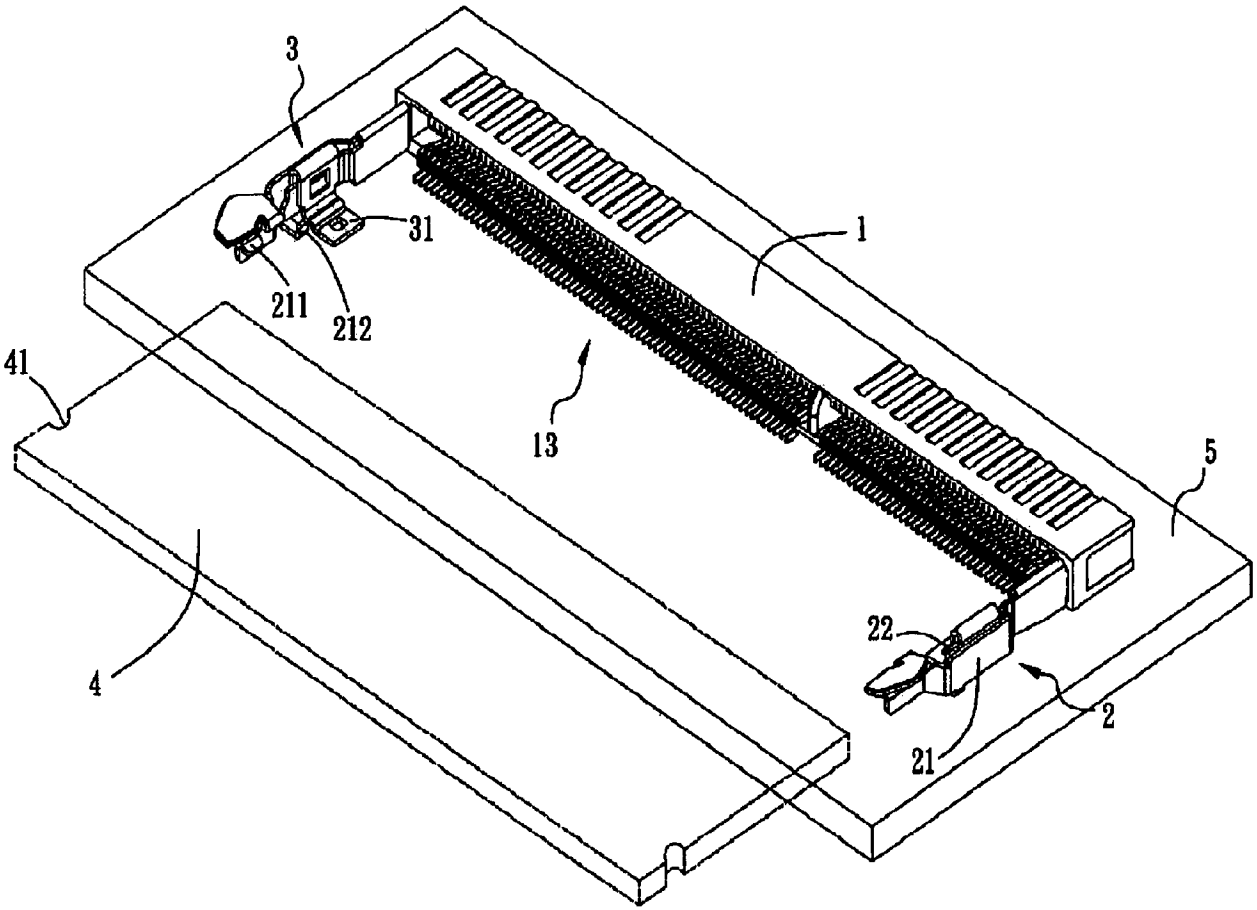
FIG. 7 is a view of assembly of the card connector and the electronic card according to a preferred embodiment of the present invention.

Referring to FIGS. 5 to 7, after the assembly of the card connector of the present invention is completed and placing on the circuit board 5, the slit formed by the fixed arm 22 and the positioning set 3 can provide to adjust the positions of the fixed arm 22 and the positioning set 3 vertical to maintain the welding end of the conducting terminals 13 and the welding portion 31 of the positioning set 3 on the same plane. Furthermore, soldering tin is injected into the positioning hole 311 of the positioning set 3 and the welding end of the conducting terminals 13. Thus the conducting terminals 13 can be steadily welded onto the circuit board 5 to upgrade the quality of the electrical connection of the card connector, and accordingly to substantially provide the convenience in assembly and to improve the yield. After welding the card connector to the circuit board 5, the electronic card 4 can be adapted into the slot 12 of the insulative housing 1, the buckling elements 211 of the movable arms 21 on the two sides of the insulative housing 1 can buckle the electronic card 4 into the semi-rounded indentation 41 to provide a steady electrically connection between the electronic card 4 and the conducting terminals 13.

According to the above description, the present invention substantially provides the novelty by having the positioning set covering the fixed arm of the side arm to enable the fixed arm move logitudewise, thus to maintain the welding end of the conducting terminals and the welding portion of the positioning set on the same plane, accordingly, the conducting terminals can be steadily welded onto the circuit board, to substantially provide the convenience in assembly and to improve the yield.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A card connector comprising:

an insulative housing, having a slot for adapting an electronic card;

said slot comprises a plurality of conducting terminals;

two side arms, respectively comprising a movable arm and a fixed arm, said movable arm and said fixed arm are positioned in a single-piece structure; said movable arm is for buckling said electronic card; and two positioning sets, respectively comprising, a first plane, a bent portion extending upwardly from said first plane, a second plane extending downwardly from said bent portion, and a welding portion extending from the other end of said first plane, wherein said welding portion and said first plane are perpendicular to each other;

said side arms respectively positioning on two sides of said insulative housing, said positioning set respectively buckling to said fixed arm from above thus to allow said fixed arm to move up and down.

2. A card connector according to claim 1, wherein said insulative housing has a positioning groove formed respectively on two sides; said side arm has a positioning element for inserting into said positioning groove.

3. A card connector according to claim 1, wherein said fixed arm of said side arm has at least one protrusion; said first plane of said positioning set has a hole formed corresponding to said protrusion.

4. A card connector according to claim 3, wherein said hole can be formed on said second plane according to a requirement.

5. A card connector according to claim 1, wherein said movable arm of said side arm has a buckling element of which bent downwardly from a distal end of said movable arm.

6. A card connector according to claim 1, wherein said movable arm of side arm has a stopper at an end without joining with said fixed arm.

7. A card connector according to claim 1, wherein said positioning set has a hole on a welding portion for welding to a circuit board.

8. A card connector according to claim 1, wherein a slit is formed between said first plane, said bent portion and said second plane.

* * * * *